US006618948B2

(12) United States Patent
Lin

(10) Patent No.: US 6,618,948 B2
(45) Date of Patent: Sep. 16, 2003

(54) HAIR GROOMER THINNING GUIDE

(76) Inventor: Mark Y. S. Lin, No. 42, Alley 33, Lane 514 Chung-Cheng Rd., Shin-Chuang City, Taipei Hsiang (TW)

( * ) Notice: Subject to any disclaimer, the term of this patent is extended or adjusted under 35 U.S.C. 154(b) by 0 days.

(21) Appl. No.: 10/025,938

(22) Filed: Dec. 26, 2001

(65) Prior Publication Data

US 2003/0136006 A1 Jul. 24, 2003

(30) Foreign Application Priority Data

May 4, 2001 (CN) ..... 90207296 U

(51) Int. Cl.[7] ..... B26B 19/38

(52) U.S. Cl. ..... 30/233.5

(58) Field of Search ..... 30/195, 196, 200, 30/201, 233, 233.5, 30, 31

(56) References Cited

U.S. PATENT DOCUMENTS 6,125,545 A * 10/2000 Yamaguchi et al. ..... 30/233.5

* cited by examiner

*Primary Examiner*—Hwei-Siu Payer
(74) *Attorney, Agent, or Firm*—Harrison & Egbert

(57) ABSTRACT

A hair groomer thinning guide relates to a hair groomer whose casing comes with a ⊏-shaped comb carrier featuring combing teeth as a thinning guide on the front end. Both the top and the bottom are equipped with a lengthy groove, with the groomer having a cylindrical switch on its top and a round-shaped adjustable knob on the bottom. The lengthy grooves on the top and bottom plates are fitted with a positioning claw and a braking claw, which are positioned correspondingly on both sides of the switch and the adjustable knob. By pressing the adjustable knob to separate the braking claw from the braking teeth, the comb carrier would then move in linear form back and forth to form irregular pitches between the combing teeth and the groomer, thus thinning the hair, and the comb carrier moves to the front end to turn in 180° forcing the comb face backward, thus freeing the thinning combing teeth.

1 Claim, 3 Drawing Sheets

HAIR GROOMER THINNING GUIDE

FIELD OF THE INVENTION

This invention relates to a simply constructed and portable electric hair groomer.

BACKGROUND OF THE INVENTION

A simply constructed and portable electric hair groomer has a lengthy and flatten shape, with the front blade covered with a thinning combing-teeth carrier, which is connected to the main body of the hair groomer allowing it to move back and forth to set thinness of hairdo. By turning said set of combing teeth toward the rear of the main body without removing the combing teeth carrier for free hairdo thinness, it makes a permanent cover for the hair groomer blade.

BRIEF SUMMARY OF THE INVENTION

A hair groomer thinning guide that relates to a hair groomer whose casing comes with a ⊏-shaped comb carrier featuring a combing teeth as thinning guide on the front end. Both the top and the bottom are equipped with a lengthy groove, with the groomer having a cylindrical switch on its top and a round-shaped adjustable knob on the bottom. The lengthy groove on the top and bottom plates are fitted with a positioning claw and a braking claw, which are positioned correspondingly on both sides of the switch and the adjustable knob. By pressing the adjustable knob to separate the braking claw from the braking teeth, the comb carrier would then move in linear form back and forth to form irregular pitches between the combing teeth and the groomer, thus thinning the hair, and the comb carrier moves to the front end to turn in 180° forcing the comb face backward, thus freeing the thinning combing teeth.

DETAILED DESCRIPTION OF THE INVENTION

Figure 1:
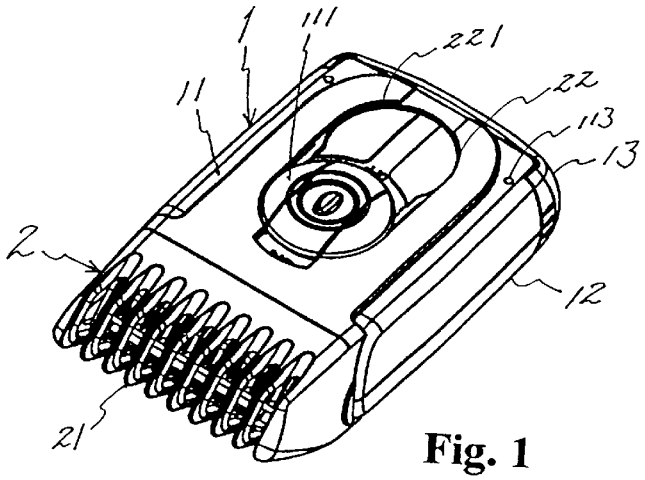
FIG. 1 shows an upper perspective view of the invention.

As shown in FIG. 1, this invention relates to a hair groomer with its main body (1) having a comb carrier (2) and the control system, where the ⊏-shaped comb carrier (2) comes with the top and bottom guides (22, 23) on the top and bottom side of the main body (1) and the combing teeth (21) on the front end of the comb carrier (2) covers the blade assembly as guard for the groomer when not in use and as hair thinner guide when in use.

Figure 2:
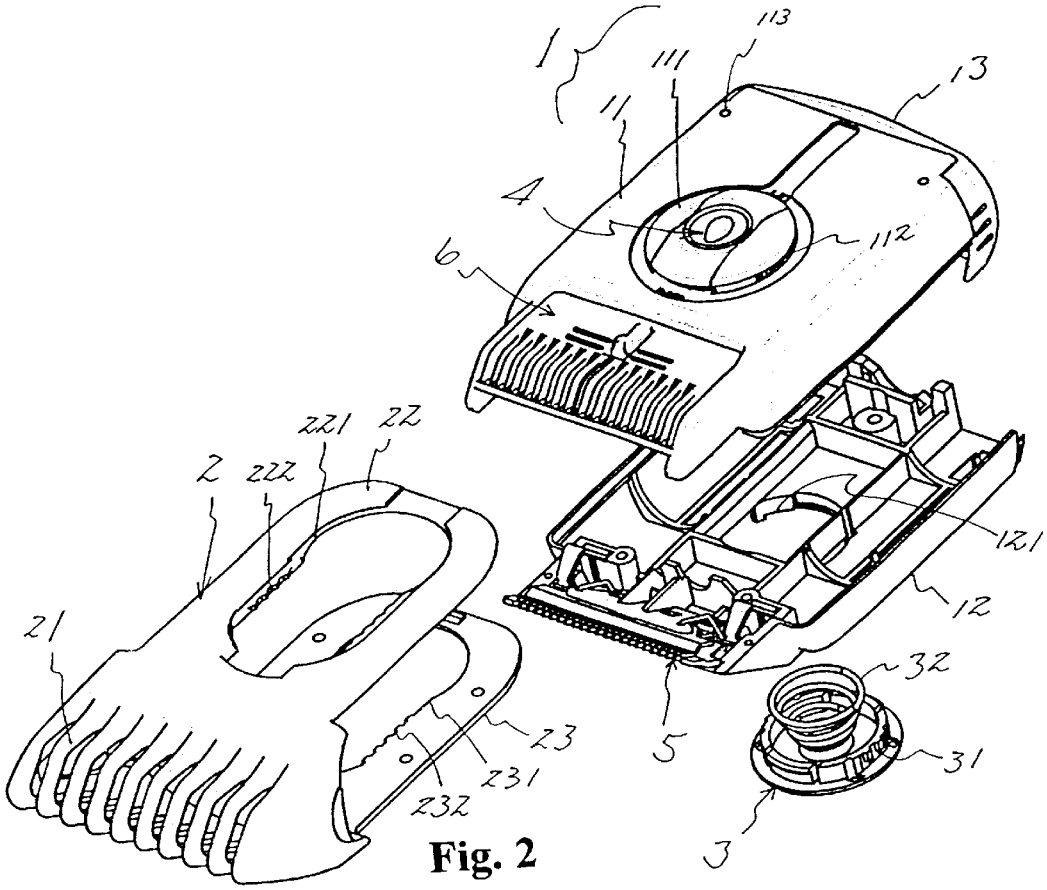
FIG. 2 shows an exploded perspective view of the invention.

Said hair groomer may be assembled as shown in FIG. 2: where the main body (1) is formed by a top casing (11) and a bottom casing (12), and the top of the top casing (11) comes with a cylindrical switch (111), which features undulated positioning claws (112) on both sides and the center features a sliding switch (4), with the front end of the top casing (11) having a sliding block (6) that cut the hair by moving back and forth; the lower part of the main body (1) is the bottom casing (12), whose front end features a blade assembly (5) and the a button seat (121) comes through the lower part in vertical position, while the end of the main body (1) features a battery cover (13) that encloses the battery. The center of the main body (1) is where the motor is housed and the left and the right side are for the battery, while the button (3), supported by a spring (32), on said button seat (121) comes in cylindrical shape and a braking claw (31) is available on the left and the right side; the comb carrier (2), as indicated above, is a ⊏-shaped carrier where the combing teeth (21) on the front form a bag, with the top and bottom guides (22, 23) coming in parallel on the top and bottom side of the main body (1) and the top of the top and bottom guides (22, 23) has long grooves (221, 231), where the long groove (221) on the top guide (22) has recessed positioning teeth (222) on the left and the right side.

Figure 3:
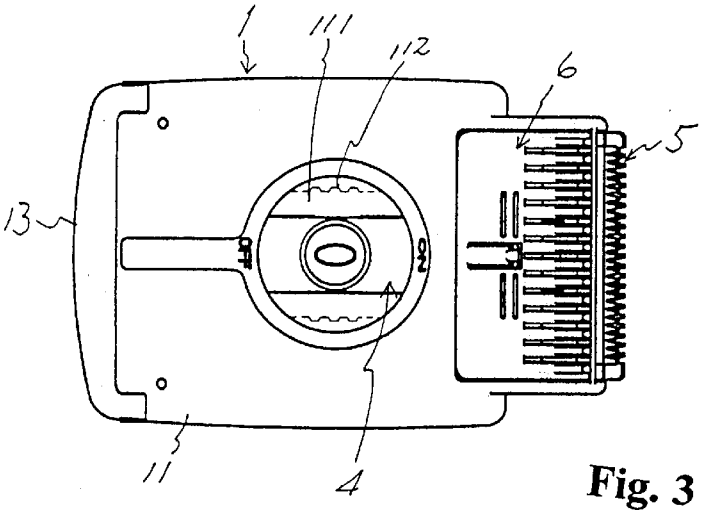
FIG. 3 shows an exploded sectional view of the comb carrier and the construction of the main body of the invention.
Figure 3:
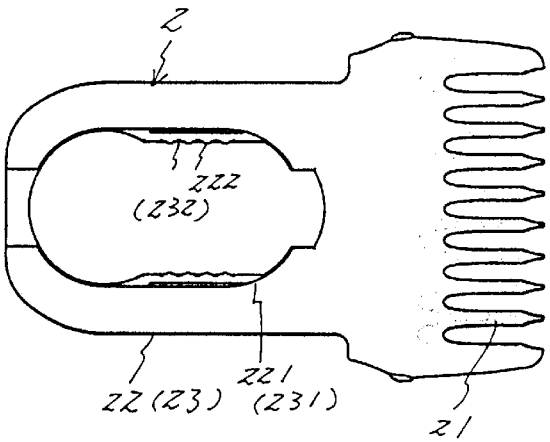
Figure 4:
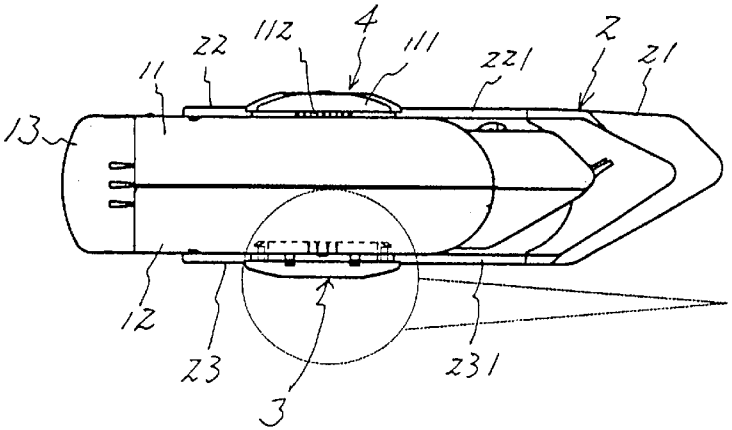
FIG. 4 shows a sectional view of the blade assembly and the movement of the invention.
Figure 4:
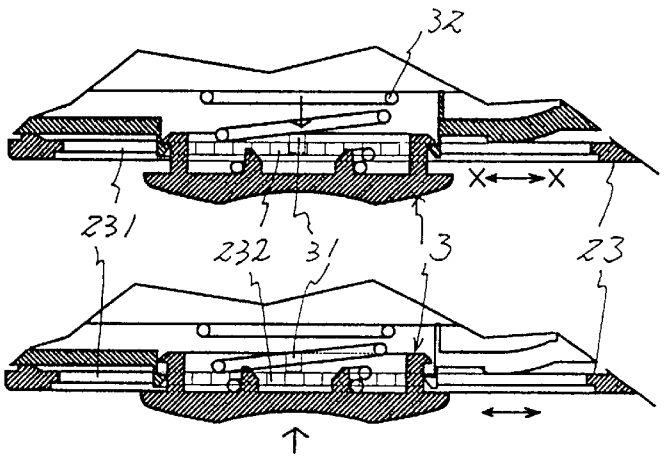

The construction of the long grooves (221)(231) of said comb carrier (2) is shown in FIG. 3, where the positioning teeth are consecutively undulated teeth to make the positioning claws on both sides of the switch seat (111) on the top casing of the main body set the move by forcibly dragging the comb carrier (2) to make an in-stage fixed positional operation through the use of the combing teeth in; the bottom guide (23) has the long groove (231) on the button (3) as shown in FIG. 4, both sides of the groove come with braking teeth (232), and the braking teeth (232) come in steep undulation that, when the braking claws (31) on both sides of the button (3) are retained, the comb carrier is held in static position and when the braking claw (31) is released from the braking teeth (232), the comb carrier becomes free; the braking teeth (232) and the positioning teeth (222) come in fixed pitches, allowing the movement of the top and bottom guides (22, 23) of the comb carrier in synchronized movement; as shown in FIG. 4, when the button (3) is pressed open by the spring (32), the braking claw (31) is retained on the braking teeth (232) of the comb carrier guide (23) and the comb carrier does not move horizontally; as shown in the lower right Figure, when the button (3) is pressed upward, the braking claw (31) is released from the braking teeth (232) area, allowing the comb carrier guide (23) to move horizontally.

Figure 5:
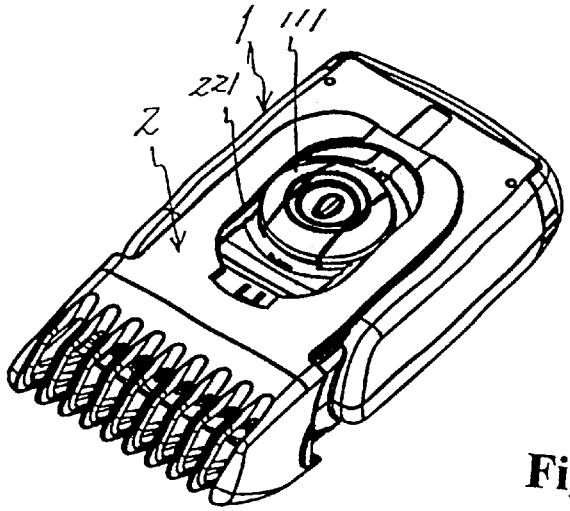
FIG. 5 shows an upper perspective view of the invention in use.
Figure 6:
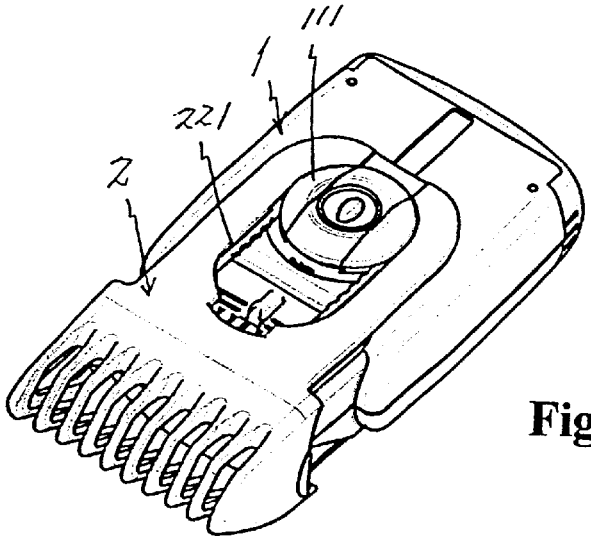
FIG. 6 shows another perspective view of the invention in use.
Figure 7:
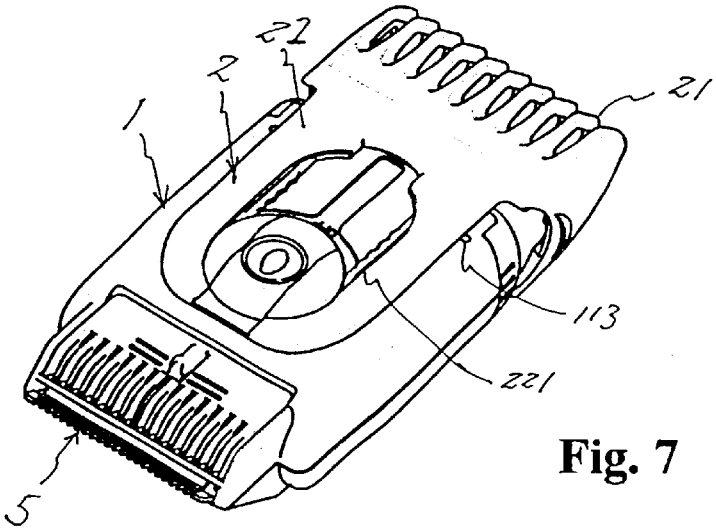
FIG. 7 shows still another perspective view of the invention in use.

Thanks to the retaining feature of said positioning teeth, positioning claw, braking teeth and braking claw, the comb carrier (2) on the main body (1) is to move freely back and forth to set the positioning; as shown in FIG. 5, when the comb carrier (2) is used to restrain the hair thinness, in-stage setting is available for the forward moving distance; further, when the comb carrier (2) reaches the end, the long groove (221) end reaches the switch seat (111) (likewise the bottom guide); as shown in the position indicated in FIG. 6, the comb carrier (2) reverses in 180°; as shown in FIG. 7, the positioning convex latch (113) on the main body (1) restrains both sides of the comb carrier (2), guide (22) to position the comb carrier (2) facing backward and keep the blade assembly (5) from being covered, as an electric hair groomer clipping down to the root of the hair.

The hair groomer thinning guide features a comb carrier on the main body of the hair groomer that serves as the guard for the hair groomer on the one hand and, on the other hand, as a comb casing to thin the hair at a pre-set height; besides, it turns open and resets easily, the comb carrier is securely connected to the main body, making it an uncommon construction to regular electric groomers. The patent application has been filed and your approval would be highly appreciated.

I claim:

1. A hair thinning guide for use with a hair trimmer having a cylindrical switch on the top thereof and a round-shaped adjustable knob on the bottom thereof, said hair thinning guide comprising:

(1) a U-shaped comb carrier having combing teeth on the front end thereof;

(2) said comb carrier having a top plate with a lengthy groove, and a bottom plate with a lengthy groove;

(3) said lengthy groove on the top plate having positioning teeth for engaging with the switch;

(4) said lengthy groove on the bottom plate having braking teeth for engaging with a braking claw on the adjustable knob; and whereby, by pressing said adjustable knob to separate said braking claw from said braking teeth, said comb carrier can be moved linearly back and forth to adjust the distance between said combing teeth and a blade assembly of said hair trimmer, thus thinning hair, and wherein said comb carrier can be moved forward and turned in 180 degrees to force the comb guide to face backward.

* * * * *